US006343387B1

(12) United States Patent
Beh

(10) Patent No.: US 6,343,387 B1
(45) Date of Patent: Feb. 5, 2002

(54) VOLUME CONTROL FOR A WATER CLOSET

(75) Inventor: Thomas P. Beh, Royal Oak, MI (US)

(73) Assignee: W/C Technology Corporation, Farmington Hills, MI (US)

( * ) Notice: Subject to any disclaimer, the term of this patent is extended or adjusted under 35 U.S.C. 154(b) by 0 days.

(21) Appl. No.: 09/730,815

(22) Filed: Dec. 6, 2000

(51) Int. Cl.[7] ..... E03D 1/00
(52) U.S. Cl. ..... 4/415; 4/354
(58) Field of Search ..... 4/354, 359, 360–362, 4/415; 137/590.5

(56) References Cited

U.S. PATENT DOCUMENTS

| | | | | | |
|---|---|---|---|---|---|
| 1,292,313 | A | | 1/1919 | Handy | 4/359 |
| 1,440,827 | A | | 1/1923 | Handy | 4/359 |
| 1,636,402 | A | | 7/1927 | Welcker | 4/359 |
| 2,616,450 | A | | 11/1952 | Legge et al. | 251/43 |
| 3,677,294 | A | | 7/1972 | Gibbs et al. | 4/354 X |
| 3,731,324 | A | * | 5/1973 | Moon | 4/415 |
| 3,732,577 | A | * | 5/1973 | Moon | 4/415 |
| 3,820,171 | A | | 6/1974 | Larson | 4/360 |
| 3,820,754 | A | | 6/1974 | Caron et al. | 4/359 X |
| 4,233,698 | A | | 11/1980 | Martin | 4/354 |
| 5,241,711 | A | | 9/1993 | Badders | 4/359 |
| 5,435,019 | A | | 7/1995 | Badders | 4/359 |
| 6,029,287 | A | * | 2/2000 | Ge et al. | 4/354 |
| 6,112,763 | A | * | 9/2000 | Orbell | 4/415 |

FOREIGN PATENT DOCUMENTS

| | | | |
|---|---|---|---|
| AT | 60693 | 8/1913 | 4/359 |

* cited by examiner

*Primary Examiner*—Gregory Huson
*Assistant Examiner*—Tuan Nguyen
(74) *Attorney, Agent, or Firm*—Dinnin & Dunn, P.C.

(57) ABSTRACT

A removable volume control apparatus 140 for a pressurized water closet 10 comprises a generally right circular cylindrical 150 insert open at both ends having a plurality of slots 154 in the bottom edge 152 thereof. A flange 142 depending from an annular valve seat 108 of the water closet 10 has a plurality of tabs 144 depending therefrom that engage the slots 154 of the insert 150 whereby the insert 150 is disposed circumferentially around a flush valve 110 of the water closet, thereby preventing the flow of a portion of water in the system into the bowl.

6 Claims, 7 Drawing Sheets

VOLUME CONTROL FOR A WATER CLOSET

FIELD OF THE INVENTION

The present invention relates to a volume control insert for a pressurized water closet flushing system that reduces water usage incident to flushing of a toilet while maintaining maximum efficiency of effluent transport.

RELATED ART

The herein disclosed volume control apparatus for a pressurized water closet represents an improvement over the systems disclosed in U.S. Pat. No. 4,233,698 issued Nov. 18, 1980 and U.S. Pat. No. 5,970,527 issued Oct. 26, 1999.

BACKGROUND OF THE INVENTION

Water conservation is an environmental concern that has resulted in strict controls being placed on domestic water usage in many areas of the country. Pressurized water closet flushing systems make a significant contribution to water conservation in that they exhibit relatively low water consumption coupled with high effluent transport efficiency.

Known pressurized water closet systems generally consist of a water vessel, a flush valve, and a flush valve actuator. These components are disposed internally of a conventional water closet. The pressurized water closet is energized by water pressure from a conventional fresh water supply system. internally of the water vessel is compressed. When water pressure in the vessel equals the supply line pressure or when it causes the pressure regulator valve to shut, in the event of supply line pressure greater than that allowed by the regulator, flow of water into the water vessel ceases and the system is conditioned for operation. When the flush valve actuator is actuated, the flush valve opens whereupon the compressed air in the water vessel forces the water stored therein into the water closet bowl at relatively high discharge pressure and velocity, flushing waste therefrom with minimum water consumption.

Known pressurized water closet flushing systems have proven successful in the marketplace but generally exhibit one or more operating characteristics that can be improved upon. In areas where fresh water supply systems have sufficient pressure to allow a pressurized water closet to readily extract waste from the water closet bowl, the mandated 1.6 gallons per flush may be more water than required to efficiently extract waste. There is no provision for readily varying the volume of water utilized in each flushing cycle, absent complex and costly modifications to the water vessel or flush control mechanisms.

SUMMARY OF THE INVENTION

The water closet volume control apparatus of the present invention, used in conjunction with a pressurized water closet flushing system, solves the aforementioned problems. Specifically, the system allows the amount of water released into the bowl for waste extraction to vary, thereby accommodating freshwater supplies of varying pressures. The pressurized water closet has a flush action that is not a function of time of actuator depression. Accordingly, when the water closet is supplied by a fresh water system having a minimum static pressure (20 PSI), the volume control insert of the present invention allows the volume of water forced into the bowl during each flush cycle to be reduced. In contradistinction, systems having less efficient bowls and/or lower water supply pressure can be operated without the volume control apparatus installed or with the volume control apparatus at its minimum height, thereby allowing the design maximum water volume to be forced into the bowl during the flush cycle.

The volume control apparatus is designed to be easily installed in the aforementioned pressurized water closets without replacement of the water vessel. Additionally, the volume control apparatus of the instant invention may be press-fitted onto the existing flange at the bottom of the water vessel, requiring no fasteners or other hardware for installation.

Yet another object of the instant invention is a variable the volume that allows any water closet to be converted to any flush volume depending on the hydraulic characteristics of a particular water closet.

The aforementioned features of the instant invention provide effective extraction and drain line carry of waste while allowing minimum water usage, depending upon the particular system hydraulics. A portion of the water contained in the vessel is "held back" during each flush cycle, thereby reducing overall water usage without compromising flushing system integrity.

BRIEF DESCRIPTION OF THE DRAWINGS

FIG. 6 is a view similar to FIG. 3 wherein the volume control apparatus of the instant invention is installed;

DETAILED DESCRIPTION OF THE PREFERRED EMBODIMENTS OF THE INVENTION

Figure 1:
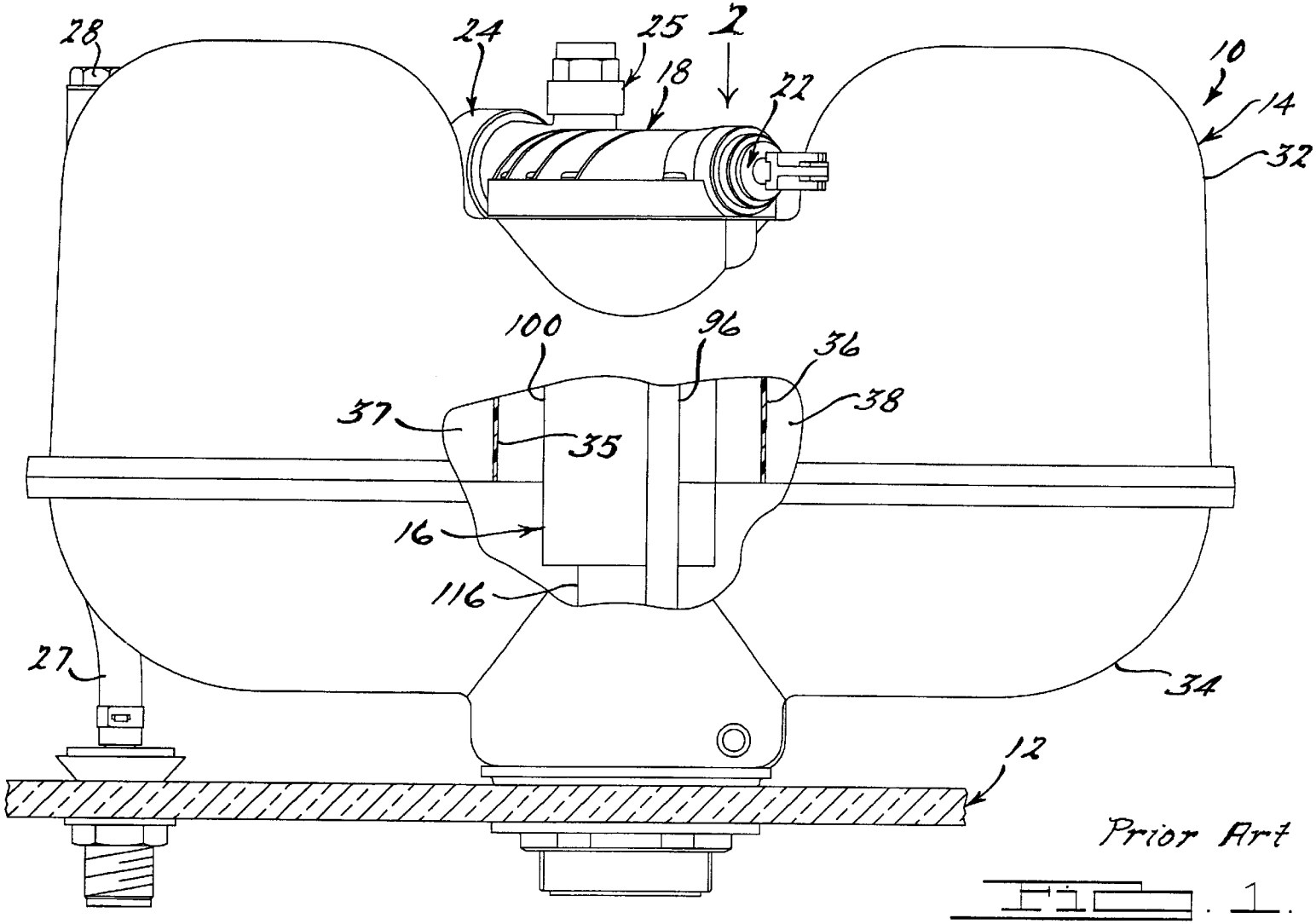
Prior Art FIG. 1
FIG. 1 is an elevational view of an improved pressurized water closet flushing system in accordance with the environment of the present invention.
Figure 2:
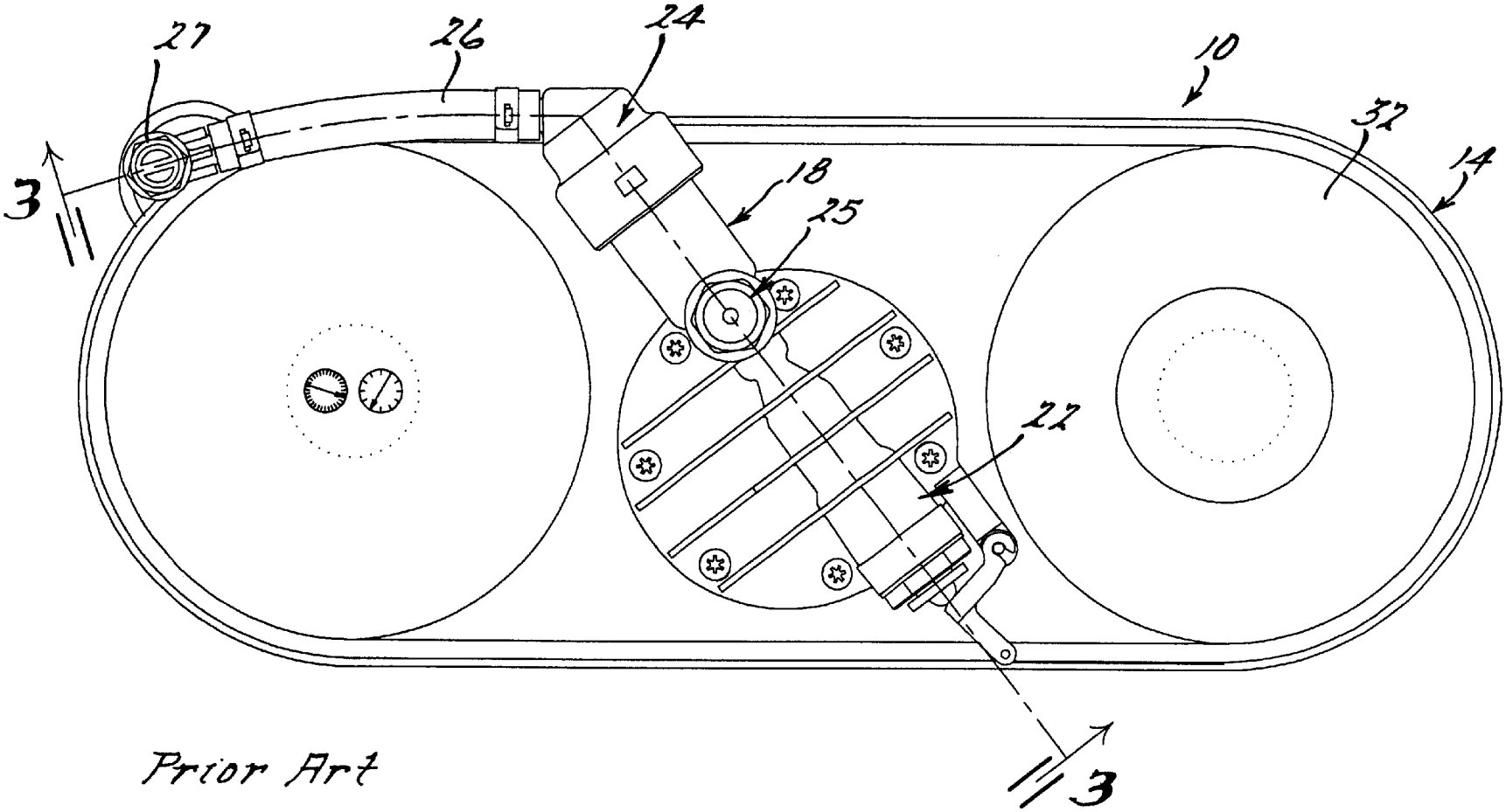
Prior Art FIG. 2.
FIG. 2 is a top view taken in the direction of the arrow "2" of FIG. 1.
Figure 3:
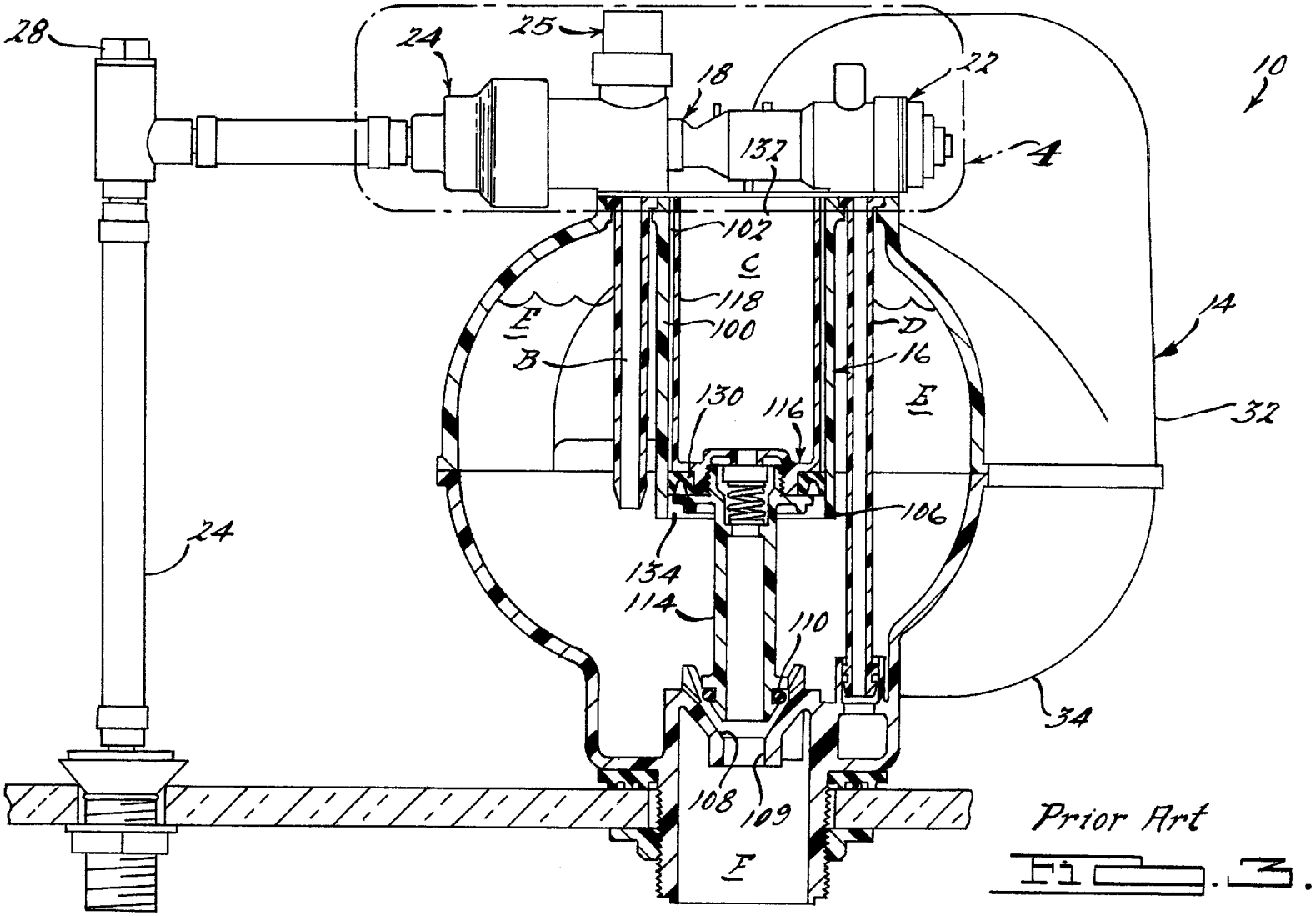
Prior Art Fig. 3
FIG. 3 is a view taken along the line 3—3 of FIG. 2; of a fully charged flushing system.

As seen in FIGS. 1, 2 and 3, a pressurized water closet flushing system 10, illustrative of the environment of the present invention and fully disclosed in U.S. Pat. No. 5,970,527, is shown in operative association with a conventional water closet tank 12. Major components of the system 10 are a water vessel 14, an internal flush valve assembly 16, and a manifold 18 comprising an integral flush valve actuator 22, a water pressure regulator 24, and an air induction regulator.

Water is supplied to the system 10 from a pressurized source (not shown) and flows upwardly without restriction through an inlet conduit 27 and vacuum breaker 28, thence laterally to the manifold 18. Water is free to flow through the conduit 27 to the manifold 18 at system pressure thence, after regulation, to both the flush valve assembly 16 and water vessel 14, as will be described.

The water vessel 14 comprises a pair of vertically stacked half sections 32 and 34. The upper section 32 of the water vessel 14 has a pair of downwardly extending partitions 35 and 36 that create isolated chambers 37 and 38, respectively as long as the water level is above the weld joint between the sections 32 and 34 of the water vessel 14, a typical condition between flushes, as will be described. Accordingly, because the compressed air in the chambers 37 and 38 which powers the system 10 is isolated, a leak in an upper portion of the flush valve assembly 16 will not result in the system 10 becoming waterlogged.

The manifold 18, comprising the water pressure regulator 24, air induction regulator 25 and flush valve actuator 22, is mounted on the upper section 32 of the water vessel 14.

Figure 4:
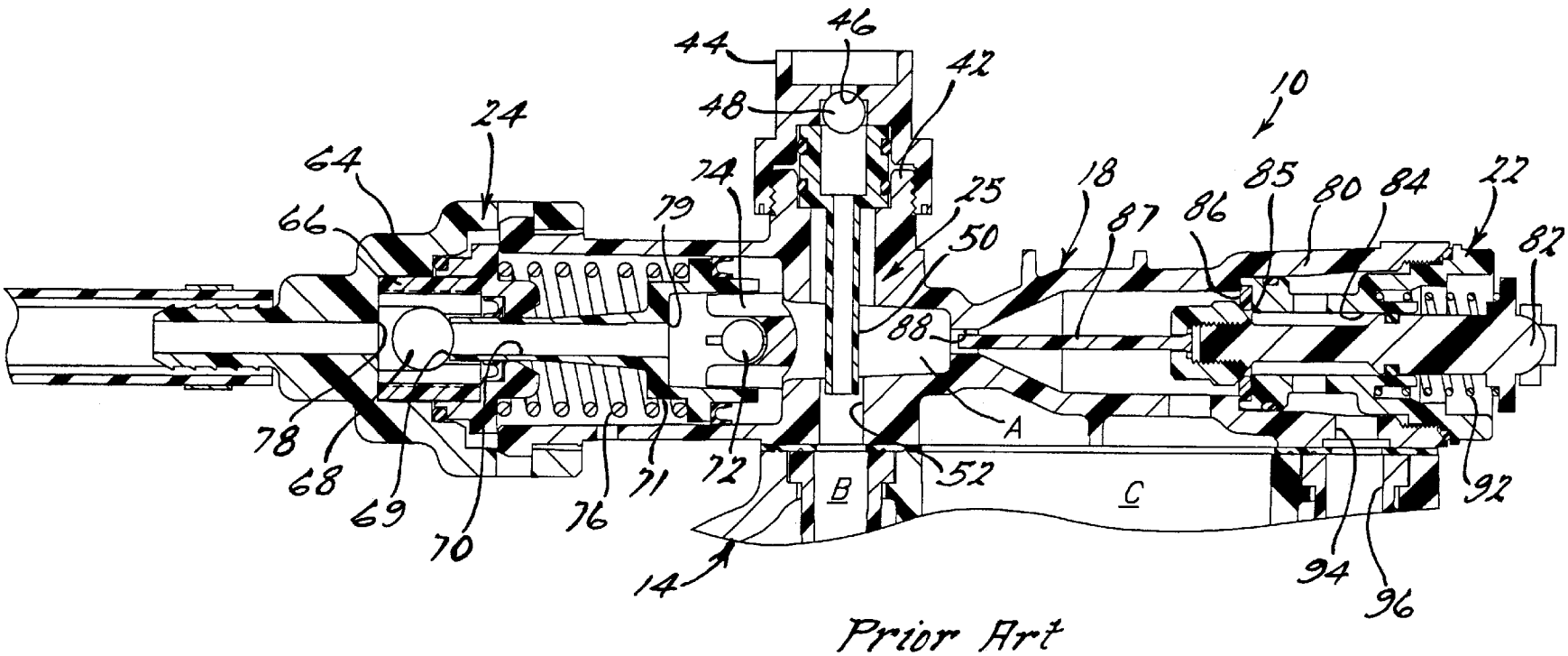
Prior Art FIG. 4
FIG. 4 is a view taken within the circle "4" of FIG. 3.

As best seen in FIG. 4, the integral air induction system 25 on the manifold 18 comprises an externally threaded mounting nipple 42 that accepts a cap 44. The cap 44 has an aperture 46 therein the periphery of which functions as a seat for a ball valve 48. The valve 48 is normally biased to the closed position by water pressure within the manifold 18. However, when internal pressure in the water vessel 14 is reduced during the discharge phase of the flush cycle, to a predetermined minimum, for example 2 PSI, the resultant flow of water into the water vessel 14 creates an air pressure differential across the valve 48 that effects opening thereof and the induction of makeup air into the water stream, replenishing air in the water vessel 14 in a self regulating manner.

A tubular sleeve 50 extends downwardly into an orifice 52 in the manifold 18 leading to the water 14 thereby to conduct air into the water stream flowing into the water vessel 14. The air induction system also functions as a vacuum breaker to preclude backflow of water from the system 10 to the water supply system in the event of pressure loss therein.

The water pressure regulator 24 on the manifold 18 is of tubular configuration and has an end cap 64 thereon. A ball valve retainer 66 of cruciform cross section is disposed internally of the end cap 64 for support of a ball valve 68. The valve 68 is biased against an annular seat 69 on a tubular portion 70 of a pressure regulating piston 71 by system water pressure when pressure internally of the water vessel 14 is lower. Similarly, a second ball valve 72 is supported in a second retainer 74, of cruciform cross section. When pressure internally of the water vessel 14 drops below the predetermined pressure, the piston 71 moves away from the end cap 64 under the bias of a regulator spring 76, thereby allowing water to flow past the ball valve 68, thence past the ball valve 72 for distribution to the flush valve 16 and water vessel 14, as will be described.

In the event of pressure loss in the water supply, the ball valves 68 and 72 move to the left, as seen in the drawing, against annular seats 78 and 79, on the end cap 64 and piston 72, respectively to preclude backflow of water from the water vessel 14 to the system.

The manifold 18 also includes the flush valve actuator 22 which comprises a cylindrical housing 80 with a manually operable spool 82 disposed internally thereof that is slidably journaled in a sleeve 84. The spool 82 carries a valve 85 that is normally seated on a valve seat 86. A needle valve 87 is supported on one end of the spool 82 so as to extend into an orifice 88 in the housing 80 to define the area of an annular water inlet orifice that controls the flow of water to the flush valve 16.

Movement of the spool 82 of the flush valve actuator 22 against the bias of a spring 92 moves the valve 85 off its seat 86 to open communication between an upper chamber "C" of the flush valve 16, through an orifice 94 to a pressure relief tube 96 to initiate flush, as will be described. The tube 96 communicates with ambient pressure in the toilet bowl (not shown).

As best seen in FIG. 3 the flush valve assembly 16 comprises a vertically oriented flush valve cylinder 100 having an upper end portion 102 that abuts the manifold 18. A lower end portion 106 of the cylinder 100 terminates short of a conical valve seating surface 108 of a water discharge passage 109 in the lower shell 34 of the water vessel 14. Flow of water from the water vessel 14 through the passage 109 is controlled by an O-ring valve 110 that is carried by a stem 114 of a flush valve piston 116.

An upper end portion 118 of the piston 116 is of cup shaped configuration and extends upwardly to a predetermined proximity, for example, 0.4 inches, from the upper end 102 of the flush valve cylinder 100 whereby upward movement of the piston 116 is limited to 0.4 inches.

The flush valve piston 116 has an elastomeric piston ring 130 thereon that effects a seal against the cylinder 100 thereby to divide the cylinder 100 into an upper chamber 132 and a main chamber 134 of the water vessel 14. The piston 116 has a valve 136 disposed centrally thereof that normally seals an aperture 138 therein. Upon the occurrence of an over pressure condition in the upper chamber 132, the valve 136 opens against a spring 139 so as to vent the upper chamber 132. This slight venting of the upper chamber 132, at, for example, 45 PSI causes a pressure differential between the upper chamber 132 and the main chamber 134 of the water vessel 14. As a result, the flush valve piston 116 starts to lift which allows the pressure in the main chamber 134 of the water vessel 14 to be reduced. Initially, an oscillation occurs as a pressure differential is repeatedly created which is eventually equalized in both chambers, thus preventing the pressure in the main chamber 134 of the water vessel 14 from exceeding a predetermined level, for example 80 PSI.

In operation, as seen in FIG. 3, the water vessel 14 is fully charged with air and water at, for example, 22 psi and the system 10 is ready for flush. Specifically, zones (A), (B), (C) and (E) are at 22 psi. Zones (D), (F) and (G) are at atmospheric pressure.

Figure 5:
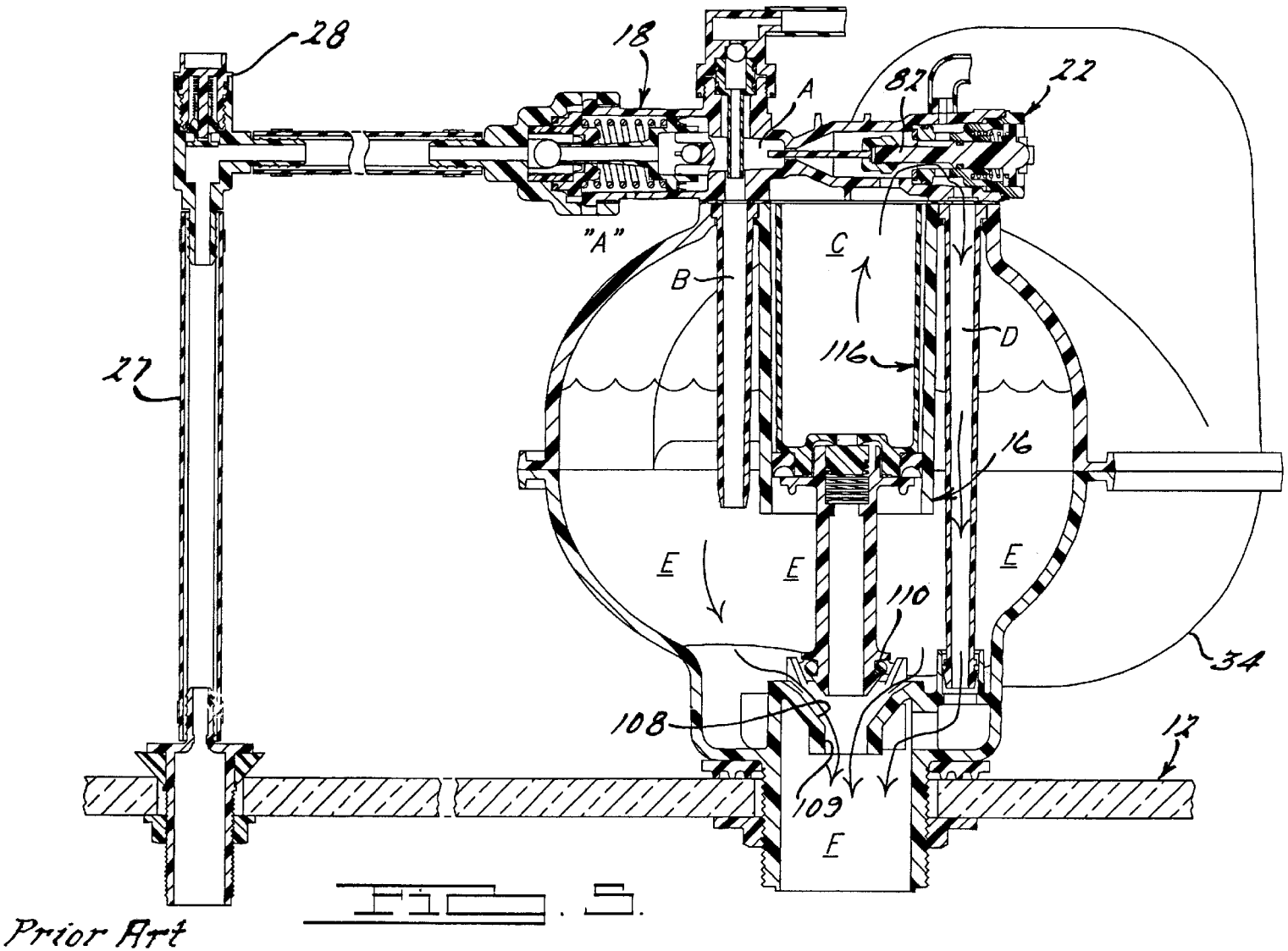
FIG. 5 Prior Art
FIG. 5 is a view similar to FIG. 3 upon the initiation of flush action.
Figure 5:
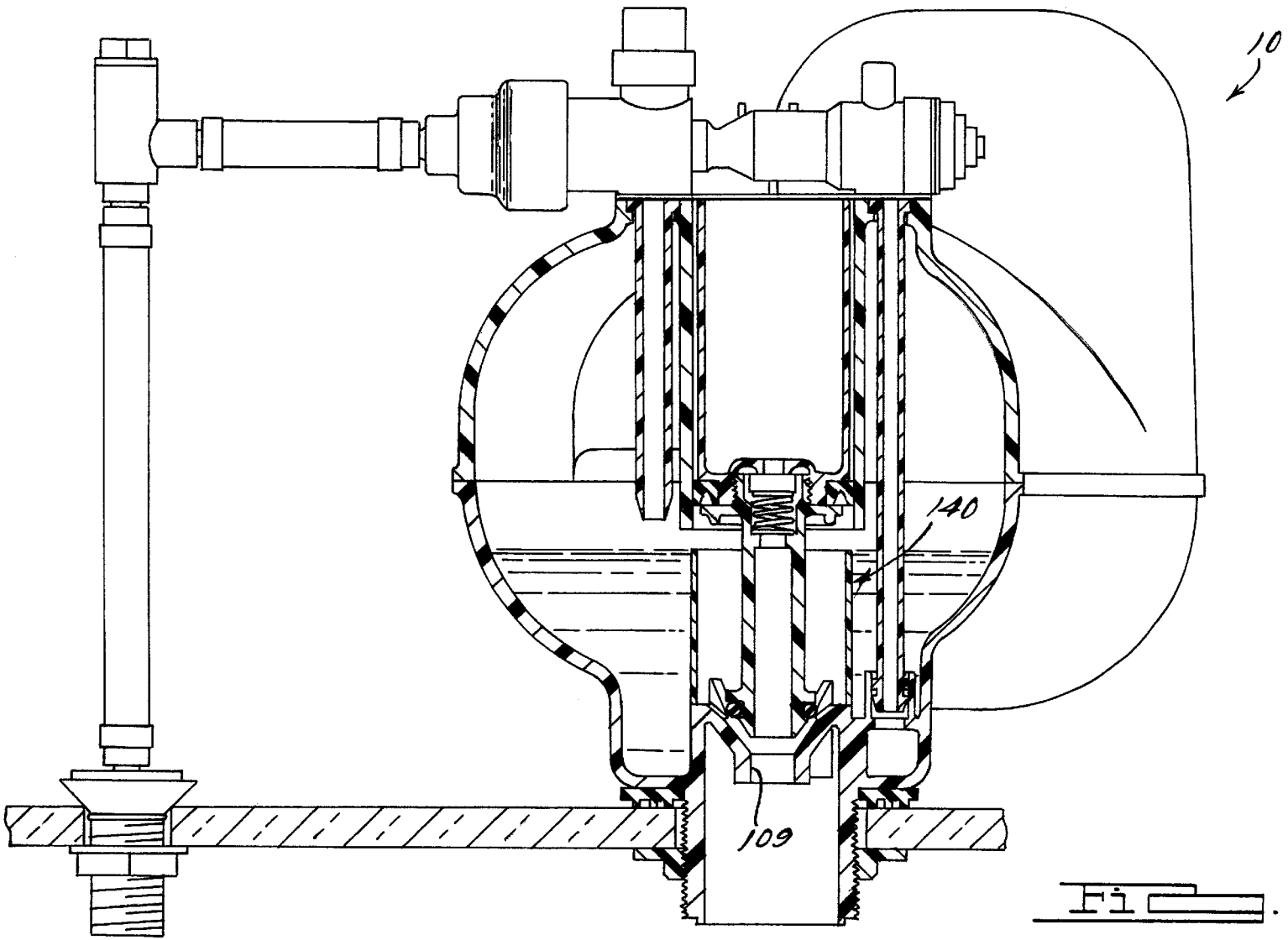

FIG. 5 illustrates the condition that obtains when flush action is initiated. Flush occurs when the actuator spool 82 of the flush valve actuator 22 is depressed, allowing pressurized water in zone "C" to discharge through the actuator 22 into zone "D" thence to zone "F. The pressure differential established between zone "E" and zone "C" forces the piston 116 of the flush valve assembly 16 to lift, creating an escape path for water in zone "E" through the discharge aperture 109 into the toilet bowl at zone "F". It is to be noted that the piston 116 of flush valve assembly 16 lifts, for example, 0.40 inches, discharging only a corresponding volume of water from zone "C". This volume of water is determined to be the amount of water capable of being discharged through the flush valve actuator 22 in ¼ second. As a result, the same amount of water is required after each flush to refill zone "C" and cause the flush valve 110 to seal regardless of whether the spindle 82 of the flush valve actuator 22 is depressed for more than ¼ second.

As flush progresses, pressure in zone "E" begins to lower, allowing the regulator 24 to begin opening and flow to begin through zone "A" to zones "B" and "C", flow through zones "A" and "B" is at maximum when pressure within vessel "E" is zero.

When bowl refill is completed, the flush valve 110 is closed, and fill and pressurization of the water vessel 14 begins. When this condition obtains all flow through zone "A" is diverted through zone "B" into zone "E" of the water vessel 14. It is to be noted that when the piston 116 of the flush valve assembly 16 is in the closed position and zone "C" is full of water, the air inducer 25 closes due to pressure buildup in zones "A", "B", "C" and "E".

Figure 7:
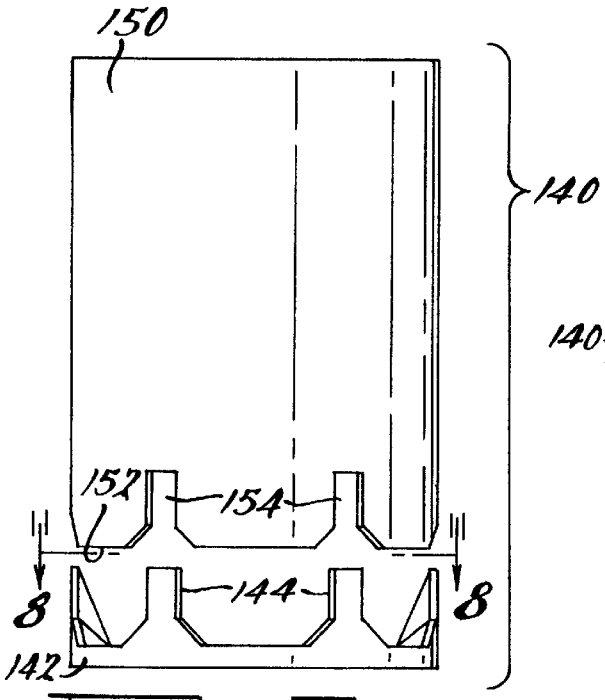
FIG. 7 is an elevational view of the volume control apparatus of the instant invention.
Figure 8:
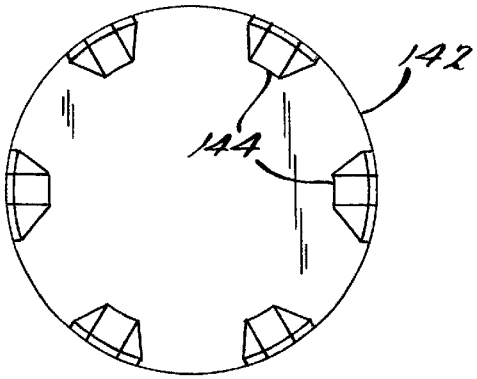
FIG. 8 is a view taken along the line 8—8 of FIG. 7.

In accordance with a preferred constructed embodiment of the instant invention, a volume control apparatus 140 is shown in FIG. 6 in operative association with the herein disclosed pressurized water closet flushing system 10. As best seen in FIGS. 6, 7, and 8, the volume control apparatus 140 comprises an annular flange 142 that depends from the annular valve seat 108 having a plurality of circumferentially spaced tabs 144 extending upwardly therefrom. The volume control apparatus 140 further comprises a generally right circular cylindrical insert 150, open at both top and bottom, having a bottom edge 152 having a plurality of circumferentially spaced slots 154 therein, wherein the slots 154 are engaged by the protruding tabs 144 of the annular valve seat 108.

Figure 9:
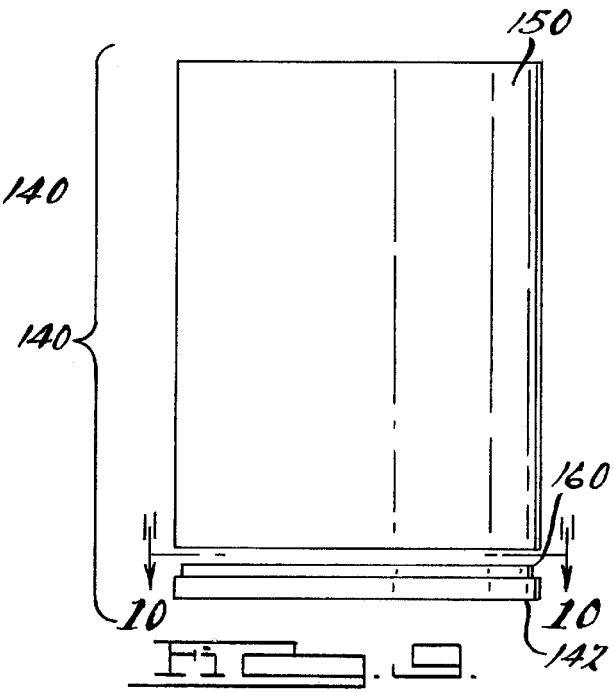
FIG. 9 is an elevational view of an alternative embodiment of the instant invention.
Figure 10:
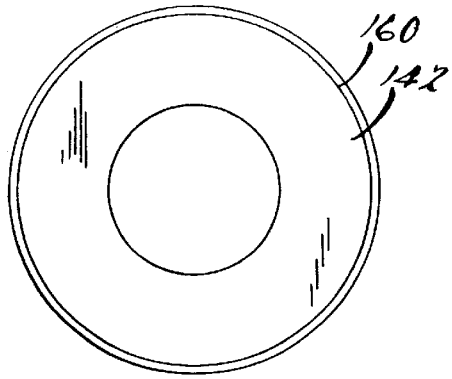
FIG. 10 is a view of the instant invention taken along the line 10—10 of FIG. 9.

In an alternative embodiment of the instant invention as shown in FIGS. 9 and 10, the annular valve seat 108 has an annular flange 142 depending therefrom having a rabbet 160 disposed around the circumference thereof. Additionally, the insert bottom edge 152 has a circumference sized to engage the rabbet 160 of said annular flange 142. In either embodiment of the instant invention, the insert 150 is press-fitted onto the annular flange 142 to provide a generally cylindrical dam disposed around the flush valve stem 114. It is not necessary that the press-fitted insert 150 form a watertight seal with the annular flange 142, just that the rate of leakage between the flange and the insert 150 be less than the rate of water flow into the tank 12 during the refill phase.

In operation, when the water closet 10 is flushed, the instant invention severely restricts water below the top edge of the insert 150 in the lower portion of the tank 12 from flowing through the passage 109, thereby reducing the water volume consumed in a pressurized flush. The instant invention may be utilized in existing water closet applications, including non-pressurized water closets, with minimal installation effort and expense. In an exemplary application, the insert 150 volume is sized to hold back approximately 0.6 gallons of water, thereby converting a 1.6 gallons per flush system to a 1 gallon per flush system and conserving a tremendous volume of water over the life of the invention.

Figure 11:
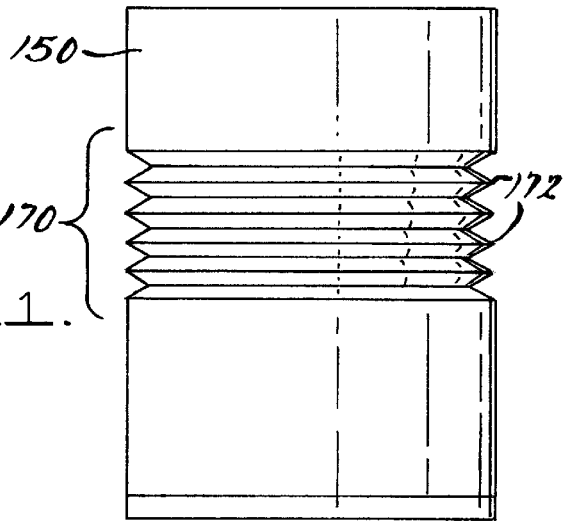
FIG. 11 is a partial view of an alternative embodiment of the instant invention.

In another alternative embodiment of the instant invention as shown in FIG. 11, the generally cylindrical insert 150 has a central portion 170 comprised of an expandable circumferential bellows 172 that allows the height of the insert 150, and therefore the volume of water held back during the flush cycle, to be readily varied based on system requirements. In this embodiment of the instant invention, the insert 150 is preferably manufactured of a flexible plastic that retains its position when the bellows 172 are expanded or contracted.

Systems having superior water supply pressure may readily transport waste from the water closet bowl while consuming less water than low-efficiency systems. In these systems, the bellows 172 may be expanded such that the insert has a greater height, thereby holding back a greater volume of water. Conversely, where the water supply pressure is sub-standard, the central bellows portion 172 of the insert 150 may be compressed to hold back the minimum water volume, thereby maximizing the system's ability to remove waste. As a result, the system 10 can be precisely tuned to different bowl configurations to obtain maximum water conservation and maximum performance. Bowl refill volume can also be varied by changing the height of the insert 150.

While the preferred embodiments of the invention have been disclosed, it should be appreciated that the invention is susceptible of modification by one of ordinary skill in the art without departing from the scope of the subjoined claims.

I claim:

1. A removable volume control apparatus for a pressurized water closet having a water vessel and an annular valve seat in a lower portion thereof, defining a water outlet in said vessel comprising:

an annular flange depending from said annular valve seat having a plurality of vertically oriented circumferentially spaced tabs;

a right circular cylindrical insert having a bottom edge having a plurality of circumferentially spaced slots therein, wherein the slots are releaseably engaged by the tabs of said annular flange; and said cylindrical insert acting as a water barrier so as to reduce the amount of water released in a flush cycle.

2. A volume control apparatus as claimed in claim 1 wherein said cylindrical insert further comprises a central portion having an expandable cylindrical bellows for varying the height of said insert.

3. A removable volume control apparatus for a pressurized water closet having a water vessel and an annular valve seat in a lower portion thereof, defining a water outlet in said vessel comprising:

an annular flange depending from said annular valve seat having a rabbet disposed around the circumference thereof;

a right circular cylindrical insert having a bottom edge which engages the rabbet of said annular flange; and said cylindrical insert acting as a water barrier and having an expandable central portion so as to adjustably control the amount of flushing water in said water vessel.

4. A volume control apparatus as claimed in claim 3 wherein said central portion includes an expandable cylindrical bellows for varying the height of said insert.

5. A removable volume control apparatus for a pressurized water closet having a water vessel and an annular valve seat in a lower portion thereof, defining a water outlet in said vessel comprising:

an annular flange depending from said annular valve seat;

a cylindrical insert having a bottom edge, a top edge, and an expandable central portion therebetween, said bottom edge releaseably engaging said annular flange, and said cylindrical insert acting as a water barrier to adjustably control the amount of flushing water in said water vessel.

6. A volume control apparatus as claimed in claim 5 wherein said central portion includes an expandable cylindrical bellows for varying the height of said insert.

* * * * *

UNITED STATES PATENT AND TRADEMARK OFFICE

CERTIFICATE OF CORRECTION

PATENT NO. : 6,343,387 B1
DATED : February 5, 2002
INVENTOR(S) : Beh

It is certified that error appears in the above-identified patent and that said Letters Patent is hereby corrected as shown below:

Column 1,
Line 29, before "internally" insert -- In operation, as the water level rises in the water vessel after flush, air --

Signed and Sealed this

Twenty-seventh Day of August, 2002

*Attest:*

*Attesting Officer*

JAMES E. ROGAN
*Director of the United States Patent and Trademark Office*